United States Patent [19]

Botimer

[11] 3,975,868

[45] Aug. 24, 1976

[54] SANDING DEVICE

[76] Inventor: Lloyd Botimer, 2122 Adams Blvd., Saginaw, Mich. 48602

[22] Filed: July 7, 1975

[21] Appl. No.: 593,883

[52] U.S. Cl. ..... 51/358; 51/370; 51/380

[51] Int. Cl.[2] ..... B24D 15/04; B24D 17/00

[58] Field of Search ..... 51/358, 370, 371, 380, 51/391, 394

[56] References Cited

UNITED STATES PATENTS

| | | | |
|---|---|---|---|
| 1,562,414 | 11/1925 | McKnight | 51/391 X |
| 2,112,593 | 3/1938 | Campbell | 51/370 |
| 2,414,036 | 1/1947 | Gerhan | 51/380 |
| 2,550,393 | 4/1951 | Wurfschmit | 51/391 |
| 3,777,444 | 12/1973 | Dunn | 51/391 |

*Primary Examiner*—Al Lawrence Smith
*Assistant Examiner*—Nicholas P. Godici
*Attorney, Agent, or Firm*—Learman & McCulloch

[57] ABSTRACT

A sanding device having a sanding block wherein sheets of sandpaper can be easily and firmly mounted upon or readily detached from the block merely by inserting inwardly bent end tabs of the paper into slots in opposite end surfaces of the block. The top and bottom surfaces of the block are flat and of isosceles trapezoidal configuration with the opposed end surfaces of the block convergently inclined toward each other at an angle of about 84° to the longitudinal centerline of the block. Slots cut into the end surfaces closely adjacent the bottom and top surfaces of the block receive bent-in ends of the piece of sandpaper, the slight angle of the end surface to the direction of sanding creating a transverse force on the paper tending to shift the paper transversely toward the longer of the longitudinal sides of the block. The paper may be folded along crease lines congruent with the opposite end edges of the block, but preferably is heated and bent along the crease lines to permanently set the end tabs. Resilient pads are mounted on the top and bottom of the block.

8 Claims, 6 Drawing Figures

SANDING DEVICE

BACKGROUND OF THE INVENTION

While sanding blocks have been widely used for many years, the wide variety of forms of such blocks is indicative of the fact that available blocks are capable of improvement. The basic requirement of a sanding block is that it should hold the sandpaper firmly, yet at the same time accommodate easy removal and replacement of the paper. In general, those blocks which have satisfactory paper-holding characteristics present some problems or inconvenience in releasing or replacing the paper, while those blocks affording ready removal and replacement of the paper frequently do not apply an adequate grip to the paper during sanding.

The present invention is specifically directed to a sanding block - paper arrangement in which opposite ends of the paper are bent inwardly and inserted in slots in the opposite ends of the block and in which the forces applied to the paper during a sanding operation tend to seat the paper more firmly against the block. The slots are so arranged that the paper may be slipped into position from the short side of the trapezoidally-shaped block and easily removed simply by withdrawing the paper in a direction opposite from that of its insertion.

SUMMARY OF THE INVENTION

A sanding device embodying the present invention consists of a simple block-like body of isosceles trapezoidal configuration when viewed in plan. The opposite end edges or surfaces of the block-like body lie in planes normal to the flat top and bottom surfaces and equally and oppositely inclined relative to the longitudinal centerline of the block at angles of about 84°. Slots parallel to the top and bottom surfaces of the block are cut into each of the opposed end surfaces at a relatively short distance inwardly from the respective top and bottom surfaces. A resilient pad of rubber or other material of similar characteristics is bonded to and entirely covers each of the top and bottom surfaces of the block.

The block may thus be loaded with two sheets of sandpaper, one over the top surface and another overlying the bottom surface. The sandpaper sheets are initially cut in rectangular configuration with a width corresponding to that of the width of the block and a length exceeding that of the length of the block. Oppositely inclined crease or score lines are formed on the back surface of the sandpaper sheet, the inclination of these lines relative to the longitudinal edges of the sheet corresponding to the angle of inclination of the end surfaces of the block to the longitudinal centerline of the block. The spacing between the two crease lines slightly exceeds that of between the opposed end surfaces of the block. Those portions of the sheet outwardly of the crease lines are bent inwardly back-to-back so that the exposed sanding surface of the sheet is formed into an isosceles trapezoid of a width corresponding to that of the top or bottom surface of the block and of a longitudinal dimension slightly exceeding the corresponding dimension of the slot. The folded sheet is then slipped onto the block by inserting the holding tabs at the long edge of the sheet sidewise into the slots at the shorter edges of the block and advancing the sheet transversely across the block while maintaining the tabs in the slots. The crease lines in the paper are so located that when the sheet is in position on the block, the crease lines are firmly seated against the edge of the slot.

Preferably, however, instead of creasing and folding, the paper is heated along the crease lines to melt or soften the glue-like abrasive binder and bent inwardly while the binder is still in a plastic condition. A permanently set end tab is achieved upon cooling of the binder.

During sanding, the slight angle of inclination of the end surface of the block relative to the direction of the sanding stroke induces a force which tends to shift the sheet transversely toward the large or longer dimensioned side of the block, thus tending to seat the sheet more firmly in the block.

Other objects and features of the invention will become apparent by reference to the following specification and to the drawings.

IN THE DRAWINGS

Figure 2:
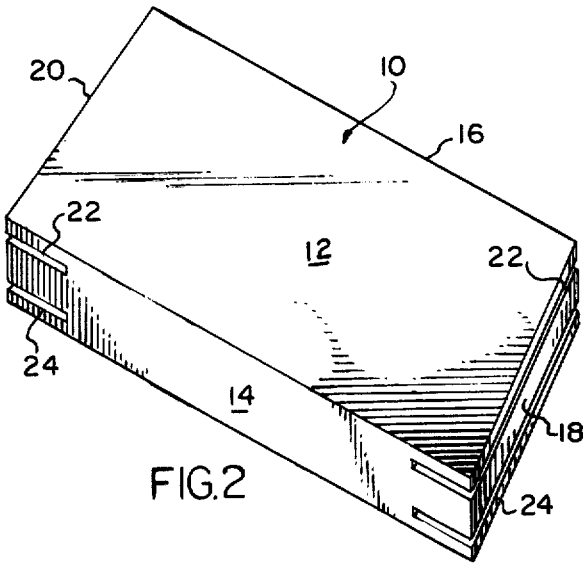
FIG. 2 is a perspective view of the block-like body of the device of FIG. 1.
Figure 4:
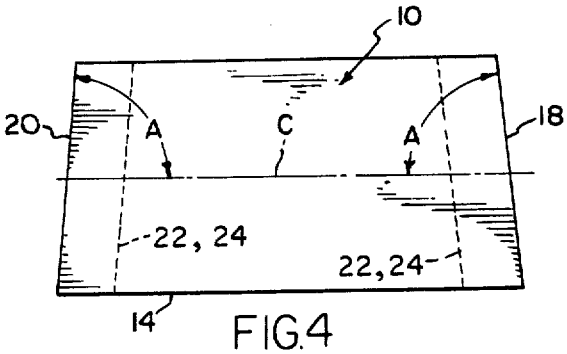
FIG. 4 is a top plan view of the block body.

Referring first particularly to FIGS. 2 and 4, a sanding device according to the present invention includes a block-like body designated generally 10 having like flat parallel top 12 and bottom (not shown) surfaces, opposed longitudinal side surfaces 14 and 16 and flat opposite end surfaces 18 and 20. As best seen in the plan view of FIG. 4, and surfaces 18 and 20 of the block are not parallel, but instead lie in planes which are symmetrically oppositely inclined relative to the longitudinal centerline of the block C by equal included angles A, which preferably are about 84°.

The top and bottom surfaces of the block thus are of isosceles trapezoidal configuration, making longitudinal side surface 14 of the block somewhat longer than its opposed longitudinal side surface 16.

A pair of slots 22, 24 are cut into each of the opposite ends of the block, the particular slots shown extending parallel to the top and bottom surfaces of the block and extending transversely entirely across the block from side surface 14 to side surface 16. Typical dimensions find the width of the slots to be approximately 1/16th of an inch, the slot width being chosen to at least slightly exceed the nominal thickness of the sandpaper to be employed with the block. The depth of the slot may be about ½ to ¾ of an inch, while the spacing of the slot from the top or bottom surface may be of the order of ⅛th of an inch.

Preferably a relatively thin sheet of rubber or some other resilient material is bonded to both the top and bottom surfaces of the block to completely overlie the surfaces.

Figure 3:
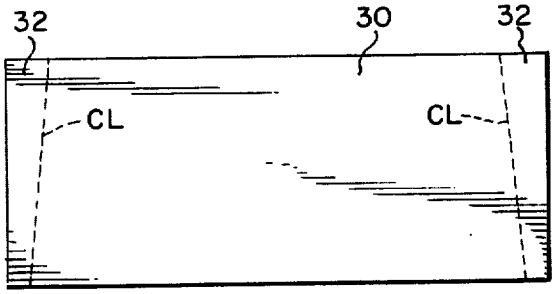
FIG. 3 is a plan view of a sandpaper sheet blank.

Referring now particularly to FIG. 3, there is shown a sandpaper blank adapted to be mounted on the holder defined by body 10 and pads 26. The blank 30 consists simply of a piece of sandpaper having a width (short dimension) corresponding to that of the top or bottom surface of the block 10 and a length or long dimension somewhat in excess of the maximum length of the block.

In one embodiment, two oppositely inclined crease lines CL are formed in the blank, as by scoring or some other method to an extent such that the binder bonding the abrasive particles of the sandpaper to the backing sheet is cracked or substantially weakened along the crease lines. To prepare the blank 30 for mounting upon the block, the holding tab portions 32 outboard of the crease lines are folded inwardly along the crease lines back surface to back surface. After folding, the working or abrasive surface of tha blank is thus formed into an isosceles trapezoidal shape, the angle of the crease lines with respect to the longitudinal side edges of the blank corresponding to the angular inclination of the opposite end surfaces 18 and 20 of the block. The crease lines CL are spaced from each other by a distance which exceeds the corresponding dimension of the block by approximately twice the dimension B (FIG. 5), the dimension B being approximately equal to the thickness of the resilient pad 26 plus the spacing between the top or bottom surface of the block and the adjacent wall surface of the slot.

Preferably, however, rather than weakening or cracking the abrasive binder the sandpaper blank is heated along the crease line by engagement with the edge of a heated metal plate to melt the binder into a plastic state. The end tabs then bent inwardly while the binder is soft. Upon cooling, the binder takes a permanent set with the end tabs 32 spaced below the main portion of the blank by a distance approximating the dimension B of FIG. 5. This arrangement finds the end tabs coupled to the main portion by a smoothly curved permanently formed portion as opposed to the cracked sharp crease or fold produced by the scoring and folding technique.

Figure 1:
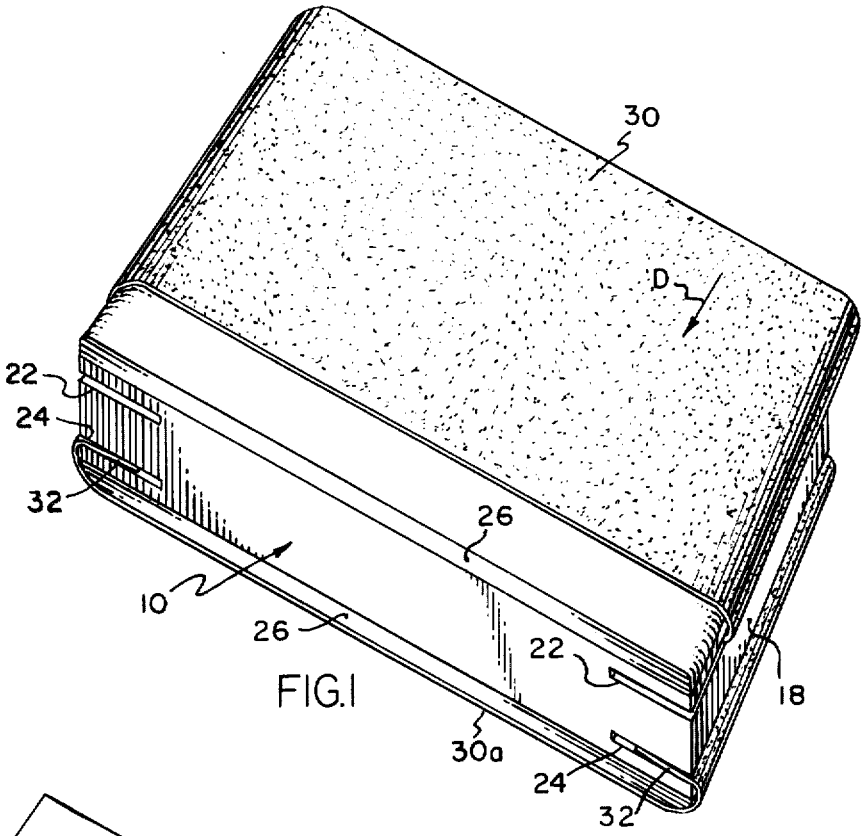
FIG. 1 is a perspective view of a sanding device according to the present invention, showing a sheet of sandpaper partially mounted upon a sanding block.
Figure 5:
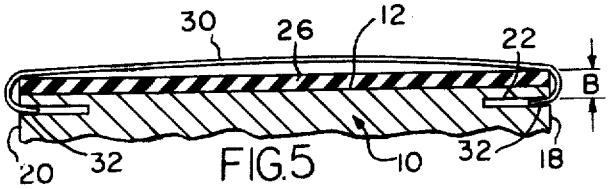
FIG. 5 is a side elevational view showing a sandpaper sheet at an initial stage of its mounting upon the block.
Figure 6:
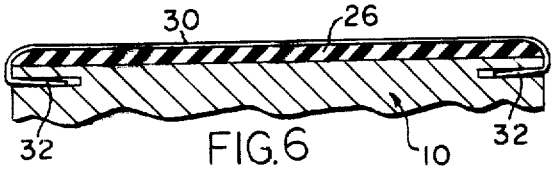
FIG. 6 is a view similar to FIG. 5 showing a sandpaper sheet fully seated upon the block.

The folded or formed blank 30 is mounted on the block by sliding the mounting tabs 32 at the longer edge of the folded blank into the slots at opposite ends of the block from the shorter longitudinal edge of the block. In FIGS. 1 and 5, the top sandpaper sheet is shown partially inserted into the block, the sheet being moved to its final direction by sliding it in the direction of the arrow D (FIG. 1) until the edges of the sheet are aligned with the edges of the block. As the sheet moves to its final seated position, the increasing length of the block stretches the sheet tightly across the block (compare FIGS. 5 and 6) and the abrasive side of the paper within the slots is bent into firm contact with the opposed wall of the slot.

While one embodiment of the invention has been disclosed, it will be apparent to those skilled in the art that the disclosed embodiment may be modified. Therefore, the foregoing description is to be considered exemplary rather than limiting and the true scope of the invention is that defined in the following claims.

What is claimed is:

1. A sandpaper holder comprising a block-like body having parallel top and bottom surfaces, opposed longitudinal side surfaces on said body, flat opposite end surfaces on said body lying in planes normal to said top and bottom surfaces and convergently inclined relative to the longitudinal centerline of said body, and means defining a slot extending inwardly of said body from each of said opposite end surfaces, said slots extending transversely of said body from one of said longitudinal side surfaces to the other and each having an opening at said end surfaces extending in parallel adjacently spaced relationship to the bottom surface of said body.

2. A sandpaper holder as defined in claim 1 wherein the angle of convergence of the planes of said end surfaces to said longitudinal centerline is between 84° and 90°.

3. The invention defined in claim 1 further comprising a flat resilient pad fixedly secured to and overlying said bottom surface.

4. The invention defined in claim 1 wherein said slots have opposed parallel side walls parallel to said bottom surface.

5. The invention defined in claim 1 comprising a pair of said slots in each of said end surfaces, each slot of each pair being spaced equidistant from the respective top and bottom surfaces of said body, and a resilient pad fixedly secured to and overlying each of said top and bottom surfaces.

6. A sanding block comprising a block like body having a flat bottom surface of isosceles trapezoidal shape, said body having opposed parallel longitudinal side surfaces and flat opposed convergently inclined end surfaces, means defining a slot extending inwardly of said body from each of said end surfaces, each slot extending from one longitudinal side surface to the other and having an opening at the end surface extending in parallel spaced adjacent relationship to said bottom surface, a sandpaper sheet having a flat main body portion of an isosceles trapezoidal configuration congruent to that of the bottom surface of said body and disposed in congruent underlying relationship with said bottom surface, and integral end tabs at each longitudinal end of said main body portion of said sheet reversely bent upwardly and inwardly of the main body portion of said sheet and projecting into said slots to retain said sheet on said bottom surface of said body.

7. The invention defined in claim 6 wherein said sheet is scored along crease lines defining opposite longitudinal ends of said main body portion of said sheet and said tabs are folded upwardly and inwardly along said crease lines.

8. The invention defined in claim 6 wherein said sheet is formed with a smoothly curved permanently set portion integrally interconnecting each of said tabs to said main body portion.

* * * * *